United States Patent [19]

Williams

[11] Patent Number: 4,934,906

[45] Date of Patent: Jun. 19, 1990

[54] HIGH PRESSURE DIAPHRAGM PUMP

[76] Inventor: James F. Williams, 21325 Placerita Canyon Rd., Newhall, Calif. 91321

[21] Appl. No.: 149,717

[22] Filed: Jan. 29, 1988

[51] Int. Cl.[5] ..... F04B 43/06
[52] U.S. Cl. ..... 417/388
[58] Field of Search ..... 417/385-388, 417/383; 137/533.31

[56] References Cited

U.S. PATENT DOCUMENTS

| | | | |
|---|---|---|---|
| Re. 25,873 | 10/1965 | Rutherford | 92/13.6 |
| 1,721,084 | 7/1929 | Newton | 137/533.31 |
| 2,578,746 | 12/1951 | Scherger et al. | 417/383 |
| 2,812,716 | 11/1957 | Gray | 417/389 |
| 3,007,416 | 11/1961 | Childs | 417/383 |
| 3,148,624 | 9/1964 | Baldwin | 417/383 |
| 3,433,161 | 3/1969 | Vetter | 417/388 |
| 3,551,076 | 12/1970 | Wilson | 92/90 |
| 3,701,618 | 1/1971 | Wall | 417/478 |
| 4,409,977 | 10/1983 | Bisera | 417/478 |
| 4,439,112 | 3/1984 | Kitsnik | 417/383 |

FOREIGN PATENT DOCUMENTS

| | | | |
|---|---|---|---|
| 56-092377 | 7/1981 | Japan | 417/383 |
| WO79/00573 | 8/1979 | World Int. Prop. O. | 92/13.6 |

OTHER PUBLICATIONS

Selecting Diaphragm Metering Pumps, Poynton Machine Design, vol. 52, No. 24, Oct. 23, 1980, pp. 88-93.

*Primary Examiner*—Leonard E. Smith
*Attorney, Agent, or Firm*—Lyon & Lyon

[57] ABSTRACT

A diaphragm pump especially suited for use in a high pressure application. The pump is devised to replenish any hydraulic fluid lost from a motor chamber, especially that fluid forced past the seals circumscribing a reciprocating plunger that is partially inserted into the motor chamber and is used as a means to alternately generate and release the high pressure that must be generated in the motor chamber to overcome the opposing high pressures existing in a pumping chamber containing a transient fluid. The motor chamber and the pumping chamber are separated by a diaphragm that is displaced according to the pressures in the motor chamber and the pumping chamber. Whenever the pressure generated in the motor chamber is such that the pressure in the pumping chamber is overcome, the pumping chamber shrinks in size and the transient fluid is expelled from the pumping chamber. Whenever the pressure in the motor chamber is released, the pumping chamber increases in size and the transient fluid is drawn into the pumping chamber.

14 Claims, 3 Drawing Sheets

HIGH PRESSURE DIAPHRAGM PUMP

BACKGROUND OF THE INVENTION

The present invention generally relates to pumps. Specifically, the invention is a diaphragm pump especially useful for high pressure pumping applications.

Various diaphragm pumps for use in low pressure pumping applications are well known in the art. Generally, these diaphragm pumps move a transient fluid by displacing a diaphragm. The displacement of the diaphragm alternatelY draws the transient fluid into a pumping chamber and expels the transient fluid from the pumping chamber. One known means used for displacing the diaphragm involves the use of a pumping plunger. The pumping plunger, partially inserted into a motor chamber, is reciprocated. The movement of the pumping plunger alternately increases and decreases the pressure exerted by the hydraulic fluid in the motor chamber. Because the diaphragm partially forms the motor chamber, the diaphragm is displaced by the change in pressure exerted by the hydraulic fluid.

Heretofore diaphragm pumps have not been found well suited for high pressure pumping applications. One obstacle to using diaphragm pumps that incorporate a pumping plunger for high pressure pumping applications is the swift loss of adequate motor chamber pressures. This loss occurs because hydraulic fluid leaks from the motor chamber around the plunger seals. This leakage occurs when the hydraulic fluid in the motor chamber is highly pressurized to overcome the opposing pressures exerted by transient fluid on the diaphragm. The high pressures generated in the motor chamber force hydraulic fluid past the plunger seals. After sufficient hydraulic fluid leaks from the motor chamber, the pump is unable to develop the motor chamber pressures necessary for effective operation.

Heretofore, those skilled in the art have attempted to solve the leakage problem by changing the seals, the seal design or the pump design. None of these changes have proven completely satisfactory based on the considerations of effectiveness, cost and reliability.

SUMMARY OF THE INVENTION

The inventor hereby discloses a novel means that permits the use of a diaphragm pump in high pressure pumping applications. The inventor recognizes that the solution to the problem faced involves the use of means to compensate for the leakage, not a means to prevent the leakage.

The disclosed device is simple, effective, inexpensive and reliable. Futhermore, the pump requires minimum maintenance because the hydraulic fluid that leaks from the motor chamber is recycled back into that chamber.

The disclosed pump involves the use of a diaphragm that is displaced according to the pressure exerted by the hydraulic fluid in a motor chamber. The displacement of the diaphragm alternately draws a transient fluid into a pumping chamber through a first check valve and expels the transient fluid out of the pumping chamber through a second check valve. The reciprocating movement of a pumping plunger partially located in the motor chamber develops and controls the pressures exerted by the hydraulic fluid on the diaphragm. Seals surround the pumping plunger at the point the plunger enters the motor chamber. The high pressures generated in the motor chamber force hydraulic fluid past the plunger seals. By the use of a recycling means, the hydraulic fluid that leaks past the plunger seals is returned to the motor chamber. The recycling means thereby constantly maintains the desired amount of hydraulic fluid in the motor chamber. Thus, the pump is capable of generating the motor chamber pressures necessary for effective operation despite leakage of hydraulic fluid from the motor chamber.

DESCRIPTION OF THE PREFERRED EMBODIMENT

Figure 1:
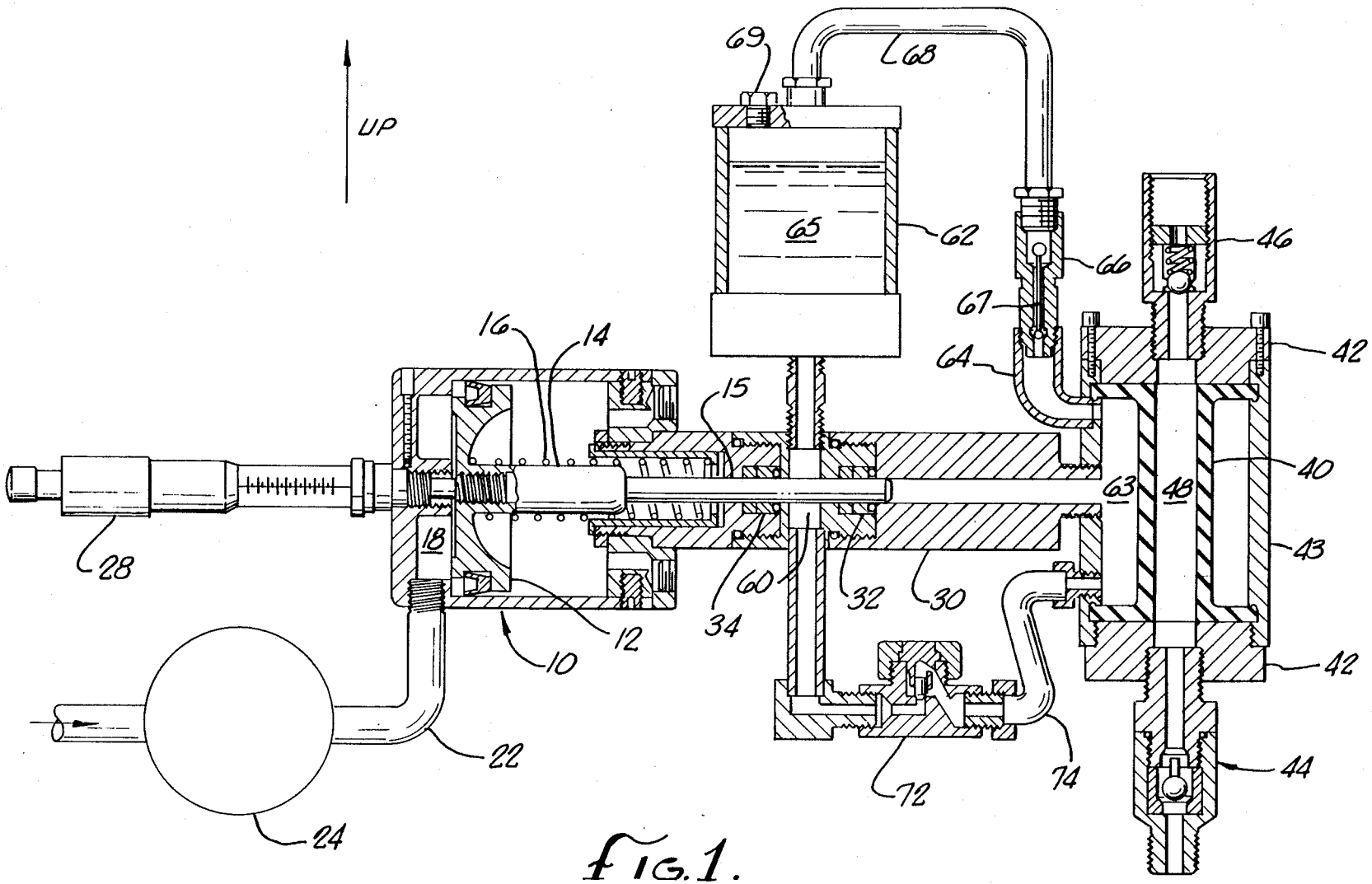
FIG. 1 is a cross-sectional view of the pump after a transient fluid is drawn into a pumping chamber through a first check valve when the motor chamber is depressurized.

Referring to FIG. 1, the pump comprises a cylinder 10 in which is contained a piston comprising a piston head 12 and a piston shaft 14 that is loaded by a spring 16. By means of a controller 24, a fluid is intermittently passed through a conduit 22 into piston chamber 18 thereby cycling the piston, and therefore the pump, at the desired rate. A preferred controller is manufactured by Williams Instrument Co., Inc. of Valencia, California and is sold under the trademark "Oscillmatic".

Connected to the piston shaft is a reciprocating plunger 15. The movement of the plunger affects, as is hereinafter described, the pressure exerted by the hydraulic fluid contained in a motor chamber 63. The plunger is contained within a plunger flange 30 and is sealed with a primary seal 32 and a secondary seal 34. By means of a stroke adjuster 28, the length of the plunger stroke can be adjusted so that the volume of a transient fluid delivered by the pump during each pumping cycle can be accurately predetermined.

Within the motor chamber and partially defining the motor chamber is a diaphragm 40 positioned between two end caps 42 being connected by a cylindrical flange 43. The diaphragm used in FIG. 1 has generally a tubular shape and this type of diaphragm is referred to herein as a squeeze diaphragm. Preferably, one of the two end caps is a bolt-on flange, rather than a screw-on flange, to avoid twisting the squeeze diaphragm during assembly. The squeeze diaphragm substantially forms a pumping chamber 48. Two check valves are connected to the pumping chamber. During each pumping cycle, the transient fluid is drawn into the pumping chamber through a first check valve 44 and is expelled from the pumping chamber through a second check valve 46.

Figure 2:
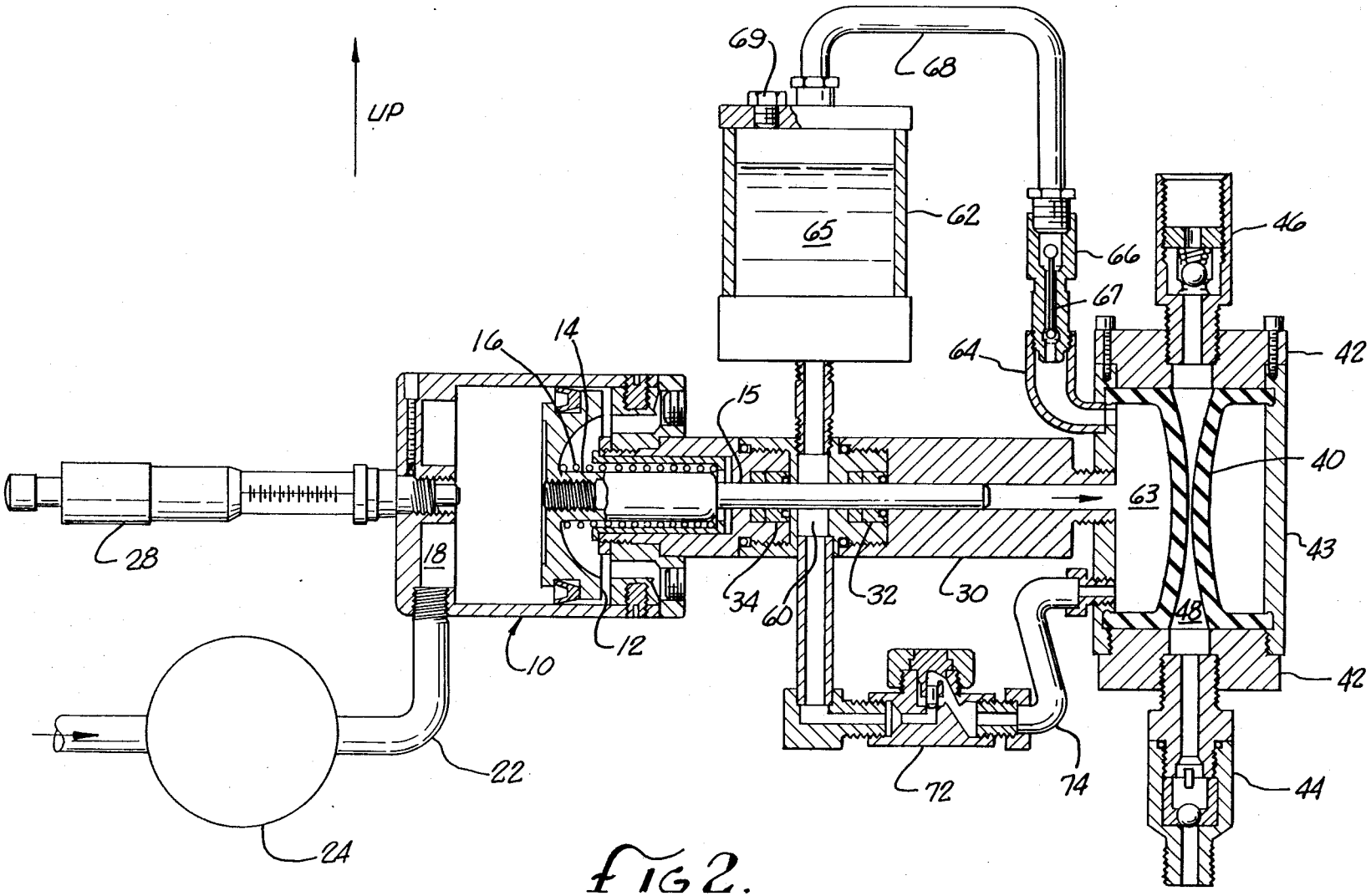
FIG. 2 is a cross-sectional view of the pump shown in FIG. 1 after the transient fluid is expelled from the pumping chamber through a second check valve when the motor chamber is pressurized.

FIG. 1 substantially shows the condition of the pump at the beginning of the pumping cycle. During the first half of the pumping cycle the plunger is pushed into the motor chamber to pressurize the hydraulic fluid. When the pressure exerted by the hydraulic fluid on the squeeze diaphragm exceeds the opposing transient fluid pressure in the pumping chamber, the squeeze diaphragm collapses and transient fluid is expelled from the pumping chamber. After the squeeze diaphragm collapses, the condition shown in FIG. 2 substantially pertains.

The high pressures exerted by the hydraulic fluid, in order to overcome the high transient fluid pressure, will generally force hydraulic fluid past the primary seal. This hydraulic fluid enters a passageway 60 and is recycled as is hereinafter described. Hydraulic fluid does not generally leak past the secondary seal because the pressure in the passageway 60 is relatively low. The passageway 60 is connected to a hydraulic fluid reservoir 62. The reservoir is preferably positioned above the motor chamber, so that gravity is used to force hydraulic fluid into the motor chamber. The reservoir contains a supplemental supply of hydraulic fluid that will permit the pump to operate for long periods of time without servicing. Additional fluid is added to the reservoir by using a fill port 69.

Figures 3, 4:
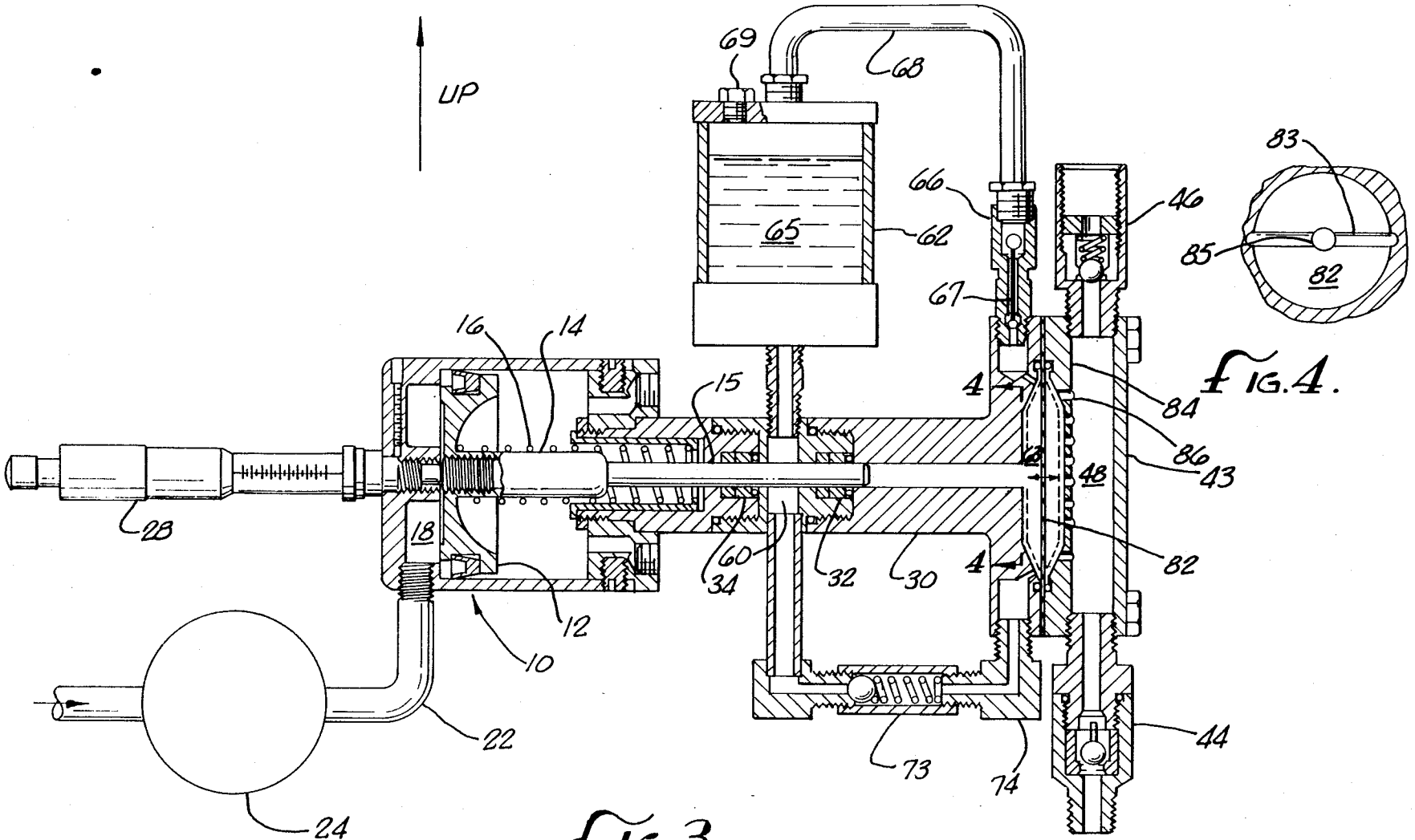
FIG. 3 is a cross-sectional view of the pump depicting an alternative embodiment for both the diaphragm assembly and the check valve assembly to that shown in FIG. 1.
FIG. 4 is a fragmentary end view of the diaphragm chamber shown in FIG. 3 taken along line 4—4.

The passageway 60 also connects to a check valve 72. The check valve also connects to a conduit 74. The check valve is designed to allow fluid to pass from the passageway 60 into the conduit 74, but not from the conduit 74 into the passageway 60. The inventor has determined that a gravity operated check valve is adequate for the intended purpose. An alternative embodiment of the check valve, being spring loaded, is depicted in FIG. 3 and therein given the number 73 rather than 72. The check valve is closed during substantially all of the first half of the pumping cycle.

The motor chamber is connected to a conduit 74 and to a conduit 64. The conduit 64 also connects to a bleeder valve 66. The bleeder valve also connects to a conduit 68. The bleeder valve is designed to allow a small amount of fluid to pass from the conduit 64 into the conduit 68 at the beginning of the pumping cycle. If the invention is correctly positioned, with the bleeder valve located above the motor chamber, then the bleeder valve provides a means for expelling gas out of the motor chamber. The gas is expelled when the bleeder valve stem 67 moves slightly at the start of each pumping cycle.

During the second half of the pumping cycle, the plunger is withdrawn from the motor chamber thereby depressurizing the hydraulic fluid. The squeeze diaphragm resumes its normal uncollapsed state and transient fluid is drawn into the pumping chamber. When the pressure exerted by the hydraulic fluid in the motor chamber falls below the static pressure generated in the passageway 60, the check valve, 72 or 73, opens and additional hydraulic fluid is forced into the motor chamber. Finally, the bleeder valve resets when gravity forces the bleeder valve stem downwards.

FIG. 3 also shows an alternative diaphragm assembly to that shown in FIG. 1. In this case, the diaphragm 82, adjacent to the motor chamber 63, has generally a flat circular shape. This type of diaphragm is referred to herein as an oscillating diaphragm. Additionally, the pumping chamber 48 is formed by the diaphragm, a cap flange 84 and a pumping chamber flange 47.

Consistent with the movement of the plunger, the pressure exerted by the hydraulic fluid in the motor chamber, and the pressure exerted by the transient fluid in the pumping chamber, the oscillating diaphragm moves back and forth between the plunger flange 30 and the cap flange containing various passageways 86. Transient fluid is thereby pumped by being alternately drawn into and expelled from the pumping chamber through the check valves 44 and 46.

FIG. 4 shows the end of plunger flange 30 juxtaposed to the oscillating diaphragm 82 in a fragmentory view taken along line 4—4 of FIG. 3. In the preferred embodiment, the end of the plunger flange 36 has a groove 83 intersecting the cylinder 85 of the plunge pump and the groove 83 extends from the inlet from conduit 74 to the inlet to bleed valve 66 which thereby insures both the flow to bleed fluid through chamber 36 and the dispersion of the hydraulic fluid across the face of the diaphragm at the start of the pumping stroke.

While exemplary versions of the invention have been described, it is to be understood that the invention is not limited to the details herein explained. It is expected that those skilled in the art will recognize numerous variations and equivalents which are within the spirit of the appended claims and which are entitled to be included therein. By way of example only, the motor chamber and the pumping chamber could be reconfigured such that the squeeze valve expands, rather than collapses, when the motor chamber is pressurized.

I claim:

1. A diaphragm pump for moving a transient fluid comprising:

(a) a motor chamber containing a hydraulic fluid;

(b) a pumping chamber;

(c) a means providing ingress to and egress from the pumping chamber for the transient fluid;

(d) a diaphragm partially defining the motor chamber and partially defining the pumping chamber;

(e) a pumping means for generating a high fluid pressure within the motor chamber and for relieving the motor chamber of the high fluid pressure, whereby the size of the pumping chamber is increased thereby drawing the transient fluid into the pumping chamber when the high fluid pressure is relieved, and whereby the size of the pumping chamber is decreased to expel the transient fluid from the pumping chamber when the high fluid pressure is generated;

(f) a bleeder means for eliminating accumulated gas and complemental hydraulic fluid from the motor chamber;

(g) a first and a second encasement means surrounding a portion of the pumping means;

(h) A first sealing means located between the pumping means and the first encasement means;

(i) a collection means for collecting substantially all of the hydraulic fluid that exits from the motor chamber through the bleeder means and that leaks from the motor chamber past the first sealing means when the high fluid pressures are generated;

(j) a second sealing means located between the pumping means and the second encasement means to prevent substantially all of the hydraulic fluid collected in the collection means from leaking from the collection means past the second sealing means; and (k) a means for injecting a supplemental hydraulic fluid into the motor chamber when the high fluid pressures are relieved, whereby substantially all of the hydraulic fluid that leaks from the motor chamber when the high fluid pressures are generated is replaced.

2. The diaphragm pump of claim 1 wherein the diaphragm is a squeeze diaphragm.

3. A diaphragm pump comprising:

(a) a cylinder defining a piston chamber, wherein the cylinder includes a piston;

(b) a means to move the piston;

(c) a reciprocating plunger partially located in a motor chamber, and positioned therein by means of a first seal, wherein the movement of the plunger is controlled by the movement of the piston, and wherein the movement of the plunger pressurizes and depressurizes a hydraulic fluid contained within the motor chamber;

(d) a diaphragm partially defining the motor chamber, wherein the movement of the diaphragm is controlled by the pressure exerted by the hydraulic fluid;

(e) a pumping chamber partially defined by the diaphragm, wherein the size of the pumping chamber is partially determined by the movement of the diaphragm, whereby a transient fluid is moved through the pumping chamber;

(f) a bleeder valve for discharging accumulated gas and complemental hydraulic fluid from the motor chamber;

(g) a collection means for collecting the hydraulic fluid that exits from the motor chamber through the bleeder valve and that leaks past the first seal when the motor chamber is pressurized;

(h) a second seal surrounding the plunger substantially preventing the collected hydraulic fluid from leaking out of the collection means; and (i) means for recycling the collected hydraulic fluid into the motor chamber.

4. The diaphragm pump of claim 3 wherein the diaphragm is substantially tubular in construction.

5. The diaphragm pump of claim 3 wherein the diaphragm is substantially flat in construction.

6. A diaphragm pump for moving a transient fluid comprising:

(a) a diaphragm;

(b) a housing structure supporting the diaphragm, wherein the housing structure and the diaphragm define at least a portion of a motor chamber, containing a hydraulic fluid, on one side of the diaphragm, and wherein the housing structure and the diaphragm define at least a portion of a pumping chamber on the other side of the diaphragm;

(c) a pumping means for displacing the diaphragm;

(d) a first and a second sealing means surrounding the pumping means;

(e) a means providing ingress to the pumping chamber for the transient fluid when the displacement of the diaphragm increases the size of the pumping chamber and egress from the pumping chamber for the transient fluid when the displacement of the diaphragm decreases the size of the pumping chamber;

(f) a bleeder means for eliminating accumulated gas and complemental hydraulic fluid from the motor chamber;

(g) a collection means for collecting at least a portion of the hydraulic fluid that exits from the motor chamber through the bleeder means and that leaks from the motor chamber past the first sealing means but not past the second sealing means; and (h) a means for recycling a portion of the collected hydraulic fluid back into the motor chamber.

7. The diaphragm pump of claim 6 wherein the diaphragm is substantially tubular in construction.

8. The diaphragm pump of claim 6 wherein the means for recycling the hydraulic fluid includes a gravity operated check valve.

9. An apparatus having a diaphragm for moving a transient fluid exerting a high pressure comprising:

(a) a pumping chamber partially defined by the diaphragm and having an ingress and an egress for the transient fluid;

(b) a motor chamber partially defined by the diaphragm and containing a hydraulic fluid;

(c) a reciprocating means acting on the hydraulic fluid that results in the hydraulic fluid alternately exerting and releasing a high pressure on the diaphragm that overcomes the opposing high pressure exerted by the transient fluid;

(d) a bleeder means for discharging accumulated gas and complemental hydraulic fluid from the motor chamber;

(e) a collection means for collecting at least some of the hydraulic fluid that exits from the motor chamber through the bleeder means and that leaks from the motor chamber past a first seal surrounding a reciprocating element when the hydraulic fluid exerts the high pressure;

(f) a second seal surrounding the reciprocating means preventing at least some of the hydraulic fluid from leaking from the collection means past the second seal; and (g) a means for recycling at least some of the hydraulic fluid that leaks from the motor chamber back into the motor chamber when the hydraulic fluid releases the high pressure.

10. The apparatus of claim 9 wherein the diaphragm is substantially tubular in construction.

11. The apparatus of claim 9 wherein the diaphragm is substantially flat in construction.

12. An apparatus for moving through a pumping chamber a transient fluid exerting a high pressure comprising:

(a) a housing structure;

(b) a substantially tubular diaphragm at least partially positioned in the housing structure;

(c) a motor chamber at least partially defined by the housing structure and separated from the pumping chamber by the diaphragm, and wherein the motor chamber contains a hydraulic fluid;

(d) a pumping means for intermittently causing the hydraulic fluid to exert a high pressure on the diaphragm, whereby the opposing high pressure exerted by the transient fluid on the diaphragm is overcome moving the transient fluid through the pumping chamber;

(e) an encasement means surrounding a portion of the pumping means;

(f) a first sealing means located between the encasement means and the pumping means wherein the hydraulic fluid leaks between the pumping means and the encasement means past the first sealing means when the high pressure is exerted on the diaphragm;

(g) a bleeder means for eliminating accumulated gas and complemental hydraulic fluid from the motor chamber;

(h) a collecting means for capturing at least some of the hydraulic fluid that exits from the motor chamber through the bleeder means and that leaks from the motor chamber;

(i) a second sealing means surrounding the pumping means preventing the captured hydraulic fluid from substantially leaking out of the collecting means; and (j) a recycling means for adding at least some of the hydraulic fluid captured by the collecting means into the motor chamber.

13. A diaphragm pump for moving a transient fluid under high pressure, the diaphragm pump having a motor chamber containing a hydraulic fluid and separated by a diaphragm from a pumping chamber, a pumping means for alternately pressurizing and depressurizing the hydraulic fluid in the motor chamber whereby the pumping chamber decreases and increases in size in accordance with the change in pressure of the hydraulic fluid in the motor chamber, a first valve providing the transient fluid ingress into the pumping chamber when the pumping chamber increases in size, a bleeder means for eliminating accumulated gas and complemental hydraulic fluid from the motor chamber a second valve providing the transient fluid egress from the pumping chamber when the pumping chamber decreases in size, a collection means for collecting substantially all of the hydraulic fluid that exits from the motor chamber through the bleeder means and that is forced from the motor chamber past a first sealing means surrounding the pumping means when the hydraulic fluid in the motor chamber is pressurized, a second sealing means surrounding the pumping means substantially preventing leakage of the collected hydraulic fluid from the collection means, and a means recycling a supplemental hydraulic fluid back into the motor chamber when the hydraulic fluid in the motor chamber is depressurized.

14. The diaphragm pump of claim 13 wherein the diaphragm is substantially tubular in construction.

* * * * *